US007472521B2

(12) United States Patent
Bilge

(10) Patent No.: US 7,472,521 B2
(45) Date of Patent: Jan. 6, 2009

(54) SYSTEM FOR MOUNTING WALL PANELS TO A WALL STRUCTURE

(76) Inventor: Henry H. Bilge, 1036 Anderson Ave., Fort Lee, NJ (US) 07024

( * ) Notice: Subject to any disclaimer, the term of this patent is extended or adjusted under 35 U.S.C. 154(b) by 127 days.

(21) Appl. No.: 11/615,979

(22) Filed: Dec. 24, 2006

(65) Prior Publication Data

US 2008/0155917 A1 Jul. 3, 2008

(51) Int. Cl.
*E04F 13/07* (2006.01)
*E04B 2/18* (2006.01)

(52) U.S. Cl. ..... 52/235; 52/506.05

(58) Field of Classification Search ..... 52/239, 52/506.05, 509, 510, 511, 512, 656.9, 235, 52/463, 468
See application file for complete search history.

(56) References Cited

U.S. PATENT DOCUMENTS

| | | | | |
|---|---|---|---|---|
| 2,116,530 | A * | 5/1938 | McCabe | 52/506.08 |
| 4,189,885 | A * | 2/1980 | Fritz | 52/287.1 |
| 4,344,267 | A | 8/1982 | Sukolics | |
| 4,829,740 | A * | 5/1989 | Hutchison | 52/475.1 |
| 5,155,958 | A * | 10/1992 | Huff | 52/235 |
| 5,212,914 | A * | 5/1993 | Martin et al. | 52/235 |
| 5,544,461 | A | 8/1996 | Sommerstein | |
| 5,546,713 | A * | 8/1996 | Voegele et al. | 52/202 |
| 5,809,729 | A | 9/1998 | Mitchell | |
| 6,170,213 | B1 * | 1/2001 | Zarrelli et al. | 52/509 |
| 6,170,214 | B1 * | 1/2001 | Treister et al. | 52/511 |
| 6,298,627 | B1 | 10/2001 | Richardson | |
| 6,484,465 | B2 | 11/2002 | Higgins | |
| 6,694,694 | B2 | 2/2004 | Zeeff | |
| 6,748,709 | B1 * | 6/2004 | Sherman et al. | 52/235 |
| 6,843,032 | B2 * | 1/2005 | Hikai | 52/287.1 |
| 2007/0022682 | A1 * | 2/2007 | Morgenegg et al. | 52/235 |
| 2007/0119105 | A1 * | 5/2007 | MacDonald et al. | 52/235 |

OTHER PUBLICATIONS

Bamco Inc. G500 wall system.

* cited by examiner

*Primary Examiner*—Robert J Canfield
*Assistant Examiner*—Christine T Cajilig
(74) *Attorney, Agent, or Firm*—Richard M. Goldberg

(57) ABSTRACT

A system for mounting wall panels to an existing wall structure, includes a plurality of wall panels, each wall panel having a main panel section and hook walls at edges of the main panel section, with the main panel section and each hook wall having a U-shaped cross-sectional profile. There are also a plurality of fastening extrusions. Each fastening extrusion includes a securing section for securing the fastening extrusion to the existing wall structure, and a retaining wall structure at one end of the securing section, the retaining wall structure including a recess which receives one hook wall of the wall panel.

11 Claims, 7 Drawing Sheets

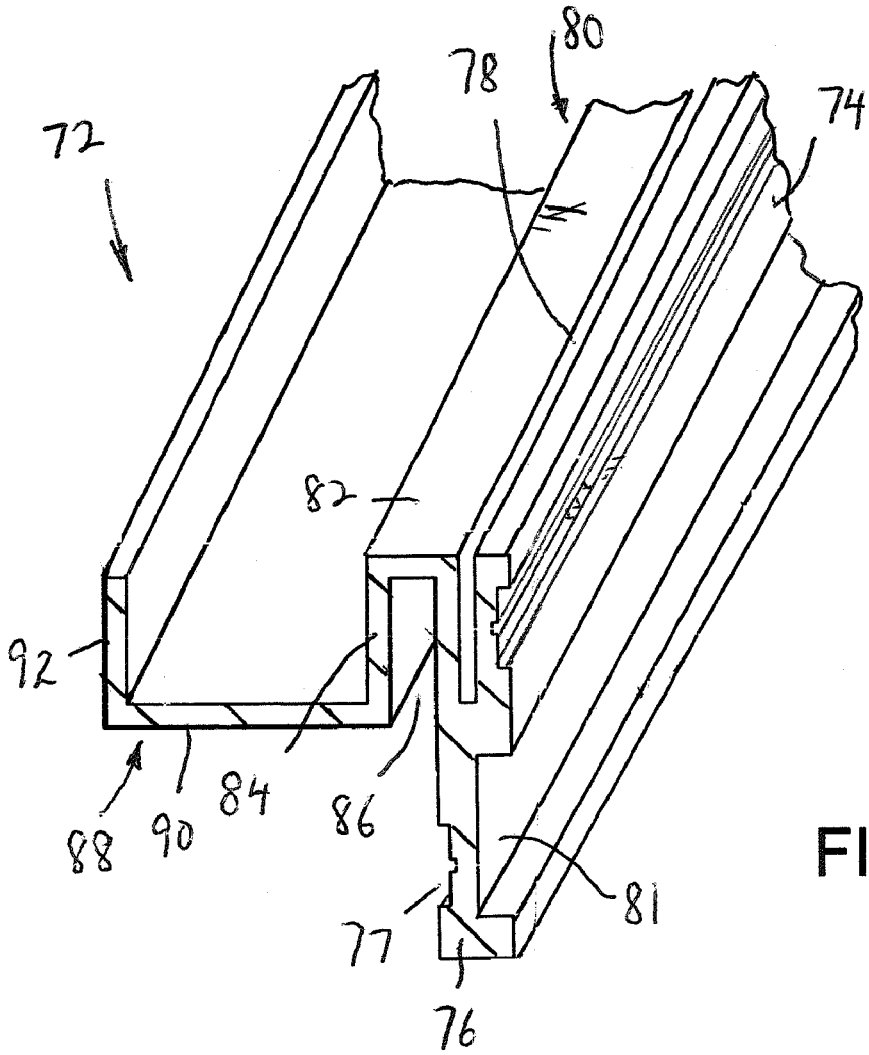
FIG. 7
FIG. 8
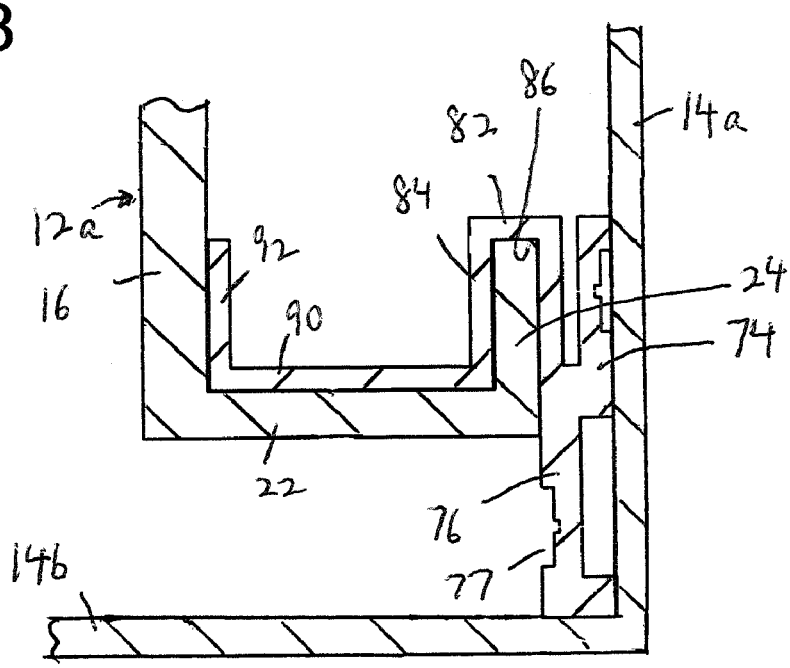

SYSTEM FOR MOUNTING WALL PANELS TO A WALL STRUCTURE

BACKGROUND OF THE INVENTION

The present invention relates generally to a wall system, and more particularly, to a system for easily mounting wall panels over an existing wall structure.

In order to enhance the look of a wall structure, it is known to secure decorative wall panels to the wall structure. However, the securement of wall panels to the wall structure is generally a long and tedious job since it entails using fastening devices such as nails and/or screws to secure the walls panels directly to the wall structure. In addition, the fastening devices are exposed, which can provide an unsightly appearance.

A system that overcomes some of these problems is sold by Bamco Inc. of 30 Baekeland Ave., Middlesex, N.J. 08846 under the designation "G500 WALL SYSTEM." With this system, the wall panels are provided with right angle or bends at their edges. Each planar panel and the right angle bend together form an L-shape. Each bend is secured by screws to a fastening extrusion having the same linear dimension as the wall panel, and the fastening extrusion having a generally rectangular cross-sectional configuration. At each joint area where two panels meet, there are two such fastening extrusions connected together, each secured to a respective wall panel, with an elongated hard silicone gasket between the fastening extrusions. The fastening extrusions are arranged one above the other at each joint area. Thus, the screws are not visible, thereby eliminating the unsightly appearance of previous system.

However, because of the L-shape at the bends at the edges of the wall panels, it is necessary to separately secure each bend to a fastening extrusion by screws, in addition to securing the fastening extrusions to the wall structure by screws, further increasing the work required to assemble the wall panels. Also, because the bends in the wall panels extend only in a direction perpendicular to the wall panels, the only structural support is provided by the screws which secure each bend to a fastening extrusion. As a result, it is possible to loosen and/or pull out the wall panels.

In addition, in order to secure the fastening extrusions to existing wall structures, one of the connected pair of fastening extrusions is provided with an extension which is separately secured to the existing wall structure. This means that the main bodies of the fastening extrusions are spaced away from the existing wall structure, thereby providing a further weak link in the structure, besides making it more difficult to assemble.

SUMMARY OF THE INVENTION

Accordingly, it is an object of the present invention to provide a wall system that overcomes the aforementioned problems.

It is another object of the present invention to provide a wall system which does not require the use of screws to secure the wall panels to the fastening extrusions.

It is still another object of the present invention to provide a wall system in which the wall panels have U-shaped hooks at their edges which are securely held at the fastening extrusions without any screws or other fastening devices.

It is yet another object of the present invention to provide a wall system that is easy to assemble with an existing wall structure.

It is a further object of the present invention to provide a wall system in which the fastening extrusions are secured flush against the existing wall structure by fastening devices, thereby increasing the structural integrity thereof.

It is a still further object of the present invention to provide a wall system that is easy and economical to manufacture and use.

In accordance with an aspect of the present invention, a system for mounting wall panels to an existing wall structure, includes a plurality of wall panels, each wall panel having a main panel section and hook walls at edges of the main panel section, with the main panel section and each hook wall having a U-shaped cross-sectional profile. There are also a plurality of fastening extrusions. Each fastening extrusion includes a securing section for securing the fastening extrusion to the existing wall structure, and a retaining wall structure at one end of the securing section, the retaining wall structure including a recess which receives one hook wall of the wall panel.

Preferably, the main panel section has a rectangular configuration with four hook walls, and there are four fastening extrusions, with the recess of the retaining wall of each fastening extrusion receiving one hook wall of the wall panel.

Further, each U-shaped cross-sectional profile defines a recess therein, and each fastening extrusion includes at least one stabilizing wall extending from a free end of a respective retaining wall, with the stabilizing wall being received in one recess of a respective U-shaped cross-sectional profile. Preferably, each stabilizing wall has an L-shaped cross-sectional profile. Also, the securing section and the retaining wall structure together define a U-shaped cross-sectional profile.

A first one of the fastening extrusions includes a tongue and a second one of the fastening extrusions includes a groove for receiving the tongue to connect together the first and second fastening extrusions when the first fastening extrusion is assembled with a first wall panel and the second fastening extrusion is assembled with a second wall panel.

Also, the securing section of each fastening extrusion includes a corner recess at least at opposite ends thereof. Corner plates are provided for engaging within the corner recesses to secure together ends of adjacent fastening extrusions to the same wall panel.

There is also at least one channel secured to the securing sections of adjacent fastening extrusions and positioned between adjacent wall panels corresponding thereto. In this regard, an elongated plug is inserted into each channel for closing off the channel.

In addition, at least one fastening extrusion includes a starter extrusion, with the securing section of each starter extrusion including an extension for securing the starter extrusion to the existing wall structure. The starter extrusion is used at edges of the wall panel corresponding to corners between a side wall and floor, two side walls, and a side wall and a ceiling.

The above and other features of the invention will become readily apparent from the following detailed description thereof which is to be read in connection with the accompanying drawings.

BRIEF DESCRIPTION OF THE DRAWINGS

FIG. 7 is a perspective view of a starter extrusion;

FIG. 8 is a vertical cross-sectional view showing the starter extrusion mounting a wall panel adjacent a floor;

DETAILED DESCRIPTION

Figure 1:
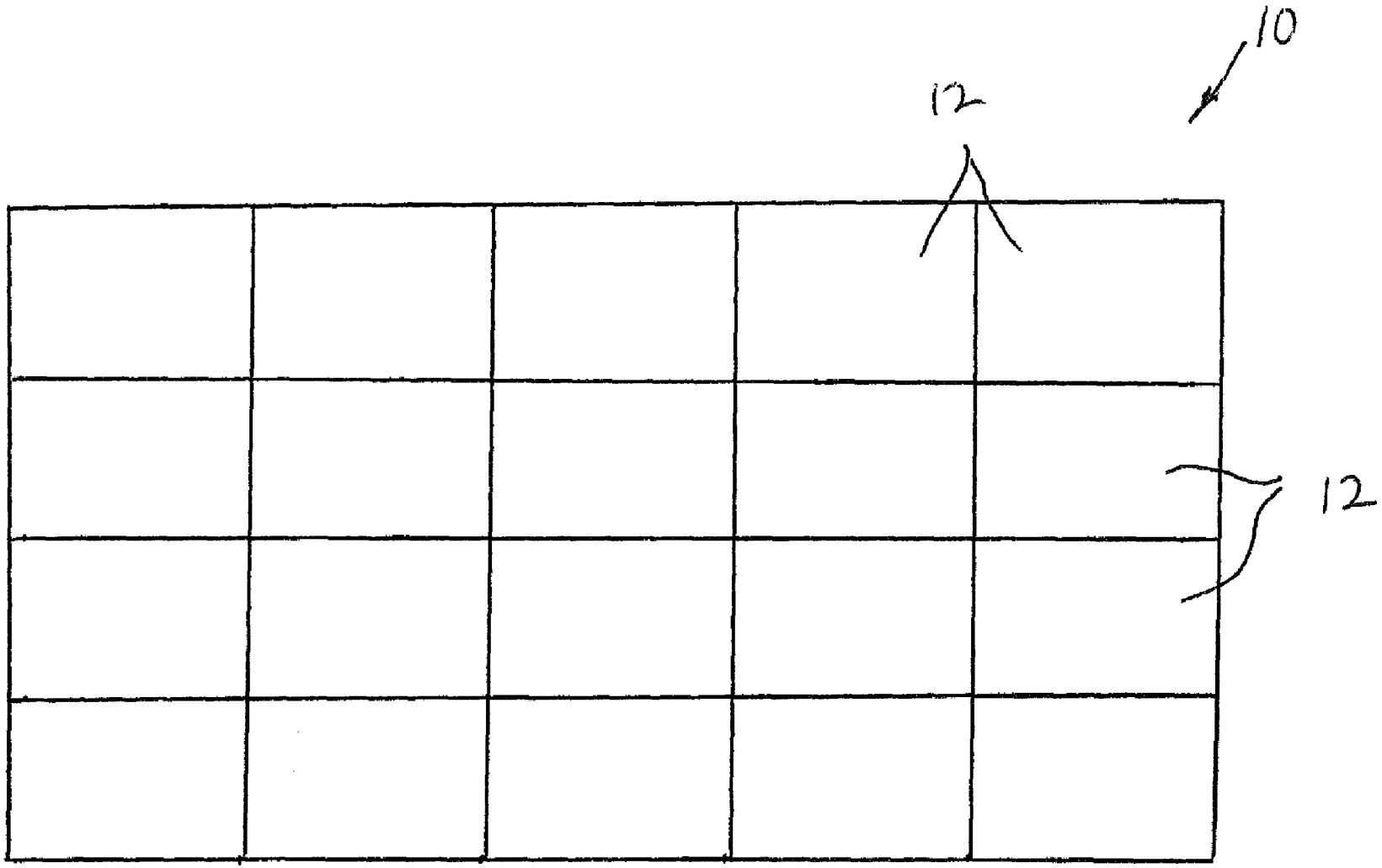
FIG. 1 is an elevational view of a plurality of wall panels mounted to an existing wall structure.

Referring to the drawings in detail, and initially to FIG. 1-4 thereof, there is shown a system 10 according to a first embodiment of the present invention for easily mounting wall panels 12 over an existing wall structure 14. Wall structure 14 preferably includes any planar wall. Each panel 12 includes a rectangular shaped, planar main panel section 16 and an L-shaped bend 18 at each edge. As a result, planar panel section 12, together with L-shaped bend 18, forms a U-shaped hook structure 20 at each edge. Specifically, each L-shaped bend 18 includes a first right angle panel section 22 at each free side edge of main panel section 16 which extends at a right angle away from main panel section 16, and a second right angle panel section 24 which extends inwardly at a right angle from the free side edge of first right angle panel section 22 such that each second right angle panel section 24 is positioned behind main panel section 16 in spaced, parallel relation thereto.

Main fastening extrusions 26 are provided for securing each wall panel 12 to existing wall structure 14. Each main fastening extrusion 22 includes a first fastening extrusion 28 and a second fastening extrusion 30 secured to first half fastening extrusion 28.

Figure 3:
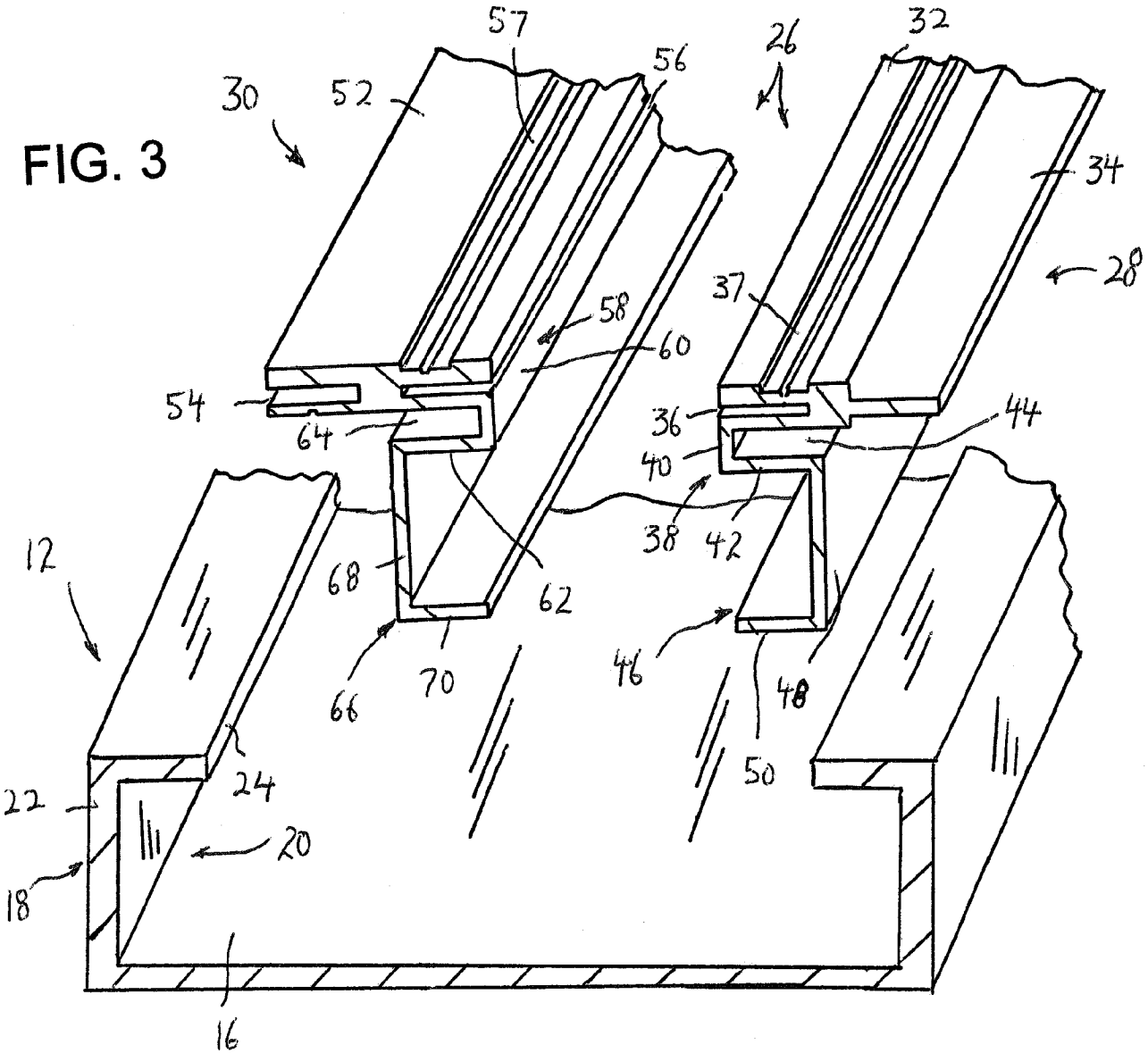
FIG. 3 is an exploded, perspective view, partially in section, showing a wall panel and two extrusions.
Figure 4:
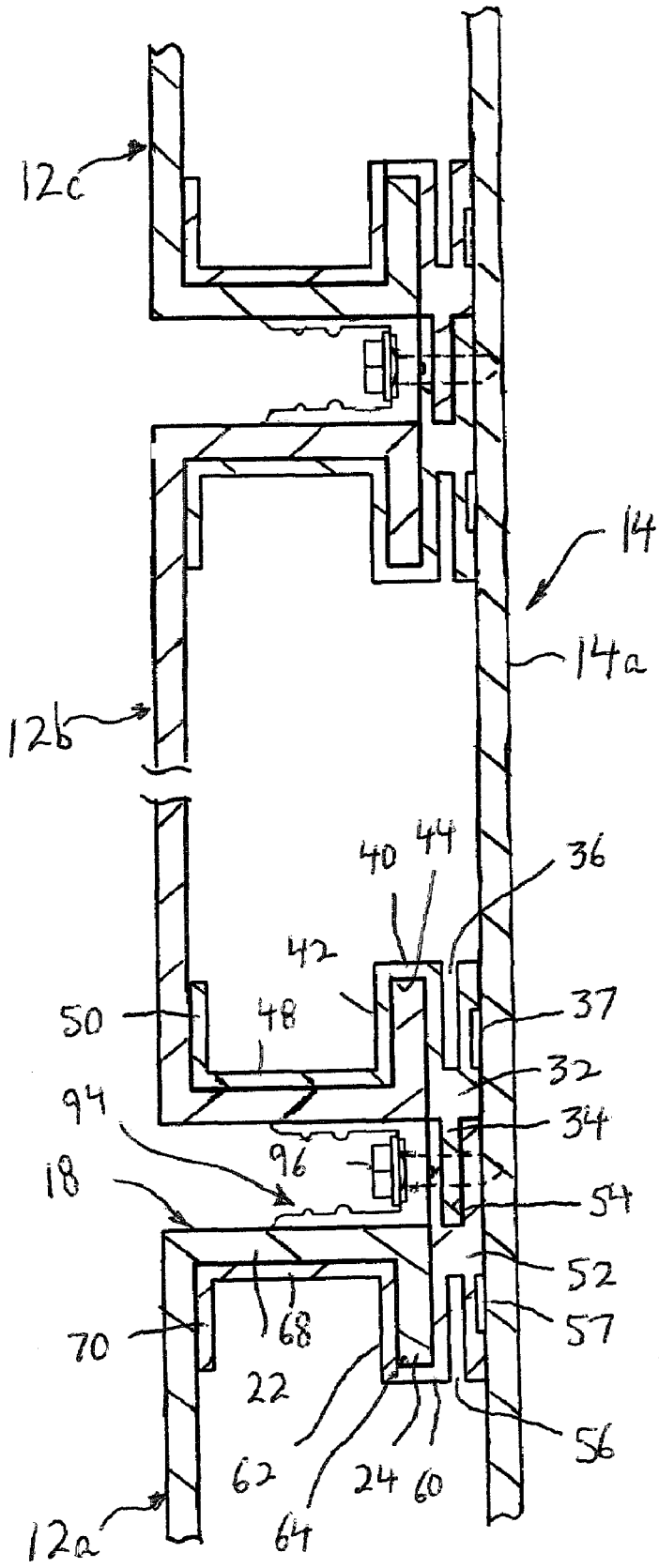
FIG. 4 is a vertical cross-sectional view showing a plurality of wall panels secured to an existing wall structure by the extrusions.

As shown best in FIGS. 3 and 4, first fastening extrusion 28 includes an elongated planar section 32 that is positioned flush against existing wall structure 14 with a horizontal orientation. A tongue 34 extends in parallel, coplanar relation along one side edge of elongated planar section 32, with the thickness of tongue 34 being less than the thickness of planar section 32. The opposite elongated side edge of planar section 32 includes a recess 36 therein. Recess 36 can extend the entire length of planar section 32, or alternatively, can be formed only at the ends of planar section 32. A shallow channel 37 is formed in the outer surface of planar section 32 in alignment with recess 36.

A U-shaped retaining wall 38 is formed at the opposite side edge of elongated planar section 32, immediately below recess 36. Specifically U-shaped retaining wall 38 is defined by planar section 32, a first right angle retaining wall section 40 at the opposite side edge of elongated planar section 32 and extending at a right angle away from planar section 32, and a second right angle retaining wall section 42 at the outer free side edge of first right angle retaining wall section 40 and extending at a right angle thereto, such that second right angle retaining wall section 42 is positioned in front of elongated planar section 32 and in spaced, parallel relation thereto. U-shaped retaining wall 32 thereby defines an inwardly directed recess 44 therein for receiving second right angle panel section 24 of hook structure 20 of a respective wall panel 12.

An L-shaped stabilizing wall 46 is secured to the free side edge of second right angle retaining wall section 42. L-shaped stabilizing wall 46 includes a first stabilizing wall section 48 secured to the free side edge of second right angle retaining wall section 42 and extending outwardly at a right angle therefrom, and a second stabilizing wall section 50 secured to the free side edge of first stabilizing wall section 48 and extending outwardly at a right angle therefrom, such that each second stabilizing wall section 50 is positioned in parallel, spaced apart relation to second right angle retaining wall section 42.

Figure 6:
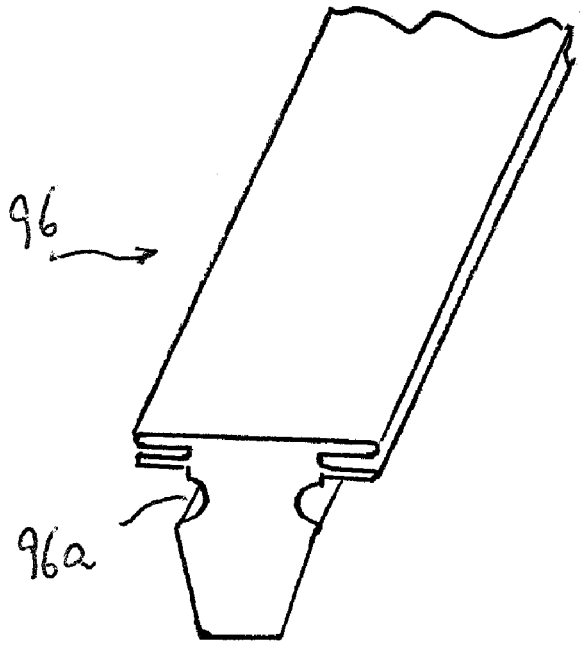
FIG. 6 is a perspective view of a rubber plug for insertion i the U-shaped channel.

In like manner, as shown best in FIGS. 3 and 6, second fastening extrusion 30 includes an elongated planar section 52 that is positioned flush against existing wall structure 14 with a horizontal orientation. A groove 54 extends in parallel relation along one side edge of elongated planar section 52, with the opening dimension of groove 54 corresponding to the thickness of tongue 34 in order to receive tongue 34 therein. The opposite elongated side edge of planar section 52 includes a recess 56 therein. Recess 56 can extend the entire length of planar section 52, or alternatively, can be formed only at the ends of planar section 52. A shallow channel 57 is formed in the outer surface of planar section 52 in alignment with recess 56.

A U-shaped retaining wall 58 is formed at the opposite side edge of elongated planar section 52, immediately below recess 56. Specifically U-shaped retaining wall 58 is defined by planar section 52, a first right angle retaining wall section 60 at the opposite side edge of elongated planar section 52 and extending at a right angle away from planar section 52, and a second right angle retaining wall section 62 at the outer free side edge of first right angle retaining wall section 60 and extending at a right angle thereto, such that second right angle retaining wall section 62 is positioned in front of elongated planar section 52 and in spaced, parallel relation thereto. U-shaped retaining wall 52 thereby defines an inwardly directed recess 64 therein for receiving second right angle panel section 24 of hook structure 20 of a respective wall panel 12.

An L-shaped stabilizing wall 66 is secured to the free side edge of second right angle retaining wall section 62. L-shaped stabilizing wall 66 includes a first stabilizing wall section 68 secured to the free side edge of second right angle retaining wall section 62 and extending outwardly at a right angle therefrom, and a second stabilizing wall section 70 secured to the free side edge of first stabilizing wall section 68 and extending outwardly at a right angle therefrom, such that each second stabilizing wall section 70 is positioned in parallel, spaced apart relation to second right angle retaining wall section 62.

Figure 2:
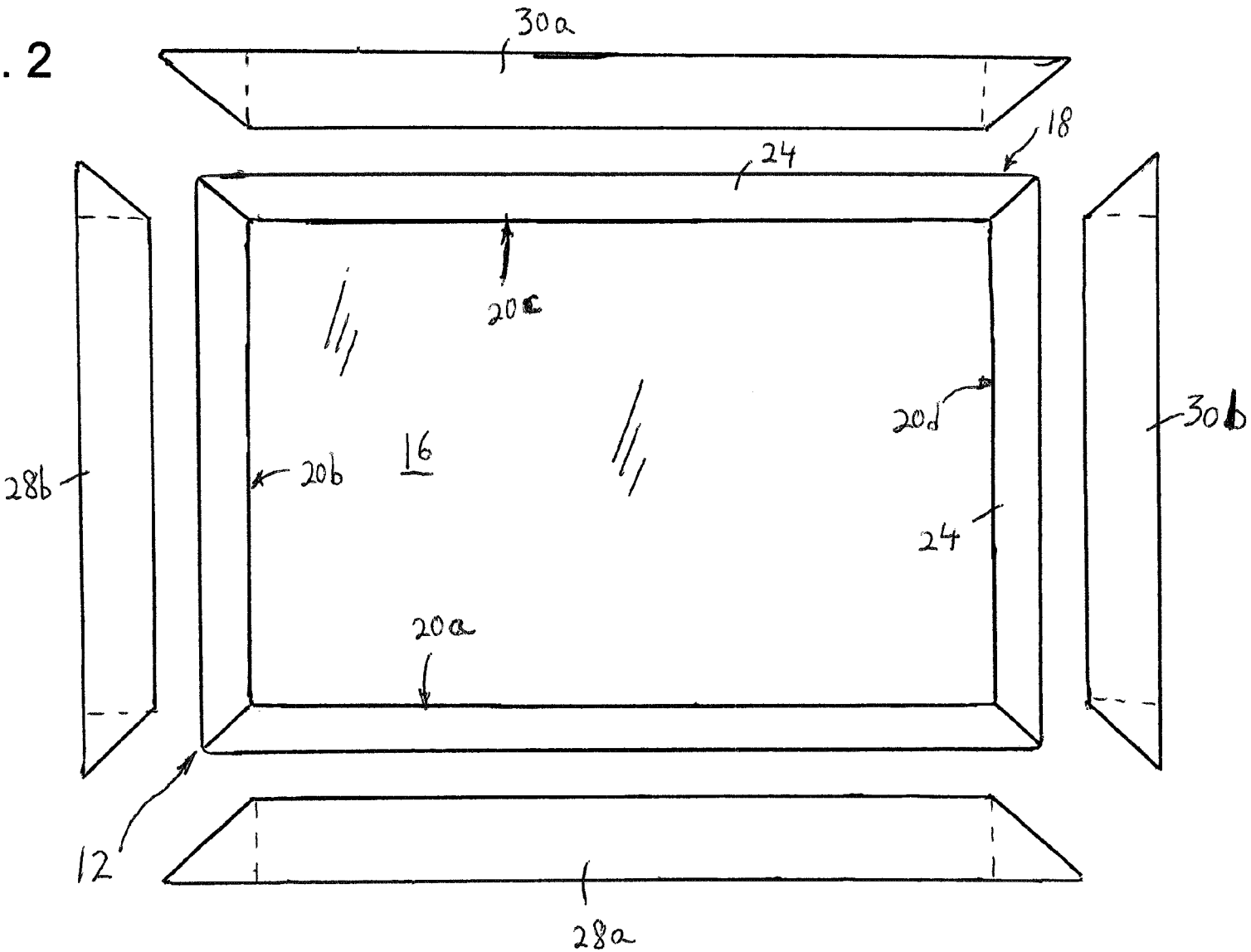
FIG. 2 is an exploded, rear plan view of a wall panel and four extrusions.

With this arrangement, panels 12 and extrusions 28 and 30 are first assembled in a shop such that two first fastening extrusions 28 and two second fastening extrusions 30 are first secured to each wall panel 12. Specifically, as shown in FIG. 2, a first fastening extrusion **28*a* is engaged with a U-shaped hook structure 20*a* at a first edge of a wall panel 12 such that second right angle panel section 24 is engaged within inwardly directed recess 44 and such that L-shaped stabilizing wall 46 is engaged within U-shaped hook structure 20. Another first fastening extrusion 28*b* is engaged in the same manner with a U-shaped hook structure 20*b* at an adjacent second edge of wall panel 12. Then, a second fastening extrusion 30*a* is engaged with a U-shaped hook structure 20*c* at a third edge of a wall panel 12 such that second right angle panel section 24 is engaged within inwardly directed recess 64 and such that L-shaped stabilizing wall 66 is engaged within U-shaped hook structure 20*c*. Another second fastening extrusion 30***b* is engaged in the same manner with a U-shaped hook structure 20*d* at an adjacent edge of wall panel 12. It will be appreciated that the ends of extrusions 28 and 30 are beveled, as shown in FIG. 2, in order meet in edge to edge contact when assembled with wall panel 12. However, this is not a requirement of the present invention, and the edges can be square, as shown by the dashed lines in FIG. 2.

In order to retain extrusions 28*a*, 28*b*, 30*a* and 30*b* assembled with panel 12, triangular corner plates 71 are inserted in recesses 36 and 56 of adjacent extrusions 28*a*, 28*b*; 28*b*, 30*a*; 30*a*, 30*b*; and 30*b*, 28*a*. A fastening device, such as a screw (not shown) is then screwed through extrusions 28, 28*b*, 30*a* and 30*b*, and through corner plates 72, thereby holding the assembly together. It will be appreciated that this is not required for the structural integrity of the system, but is merely provided to enable the panels 12 and extrusions 28 and 30 to be assembled off premises and then transported and assembled at a premises.

In order to start the assembling process, a starter extrusion 72 is provided, as shown in FIGS. 7 and 8, which is the same as first fastening extrusion 28, that is, with an elongated planar section 74, recess 78, narrow channel 79, U-shaped retaining wall 80, first right angle retaining wall section 82, second right angle retaining wall section 84, inwardly directed recess 86, L-shaped stabilizing wall 88, first stabilizing wall section 90 and second stabilizing wall section 92 corresponding respectively to elongated planar section 32, recess 36, narrow channel 37, U-shaped retaining wall 38, first right angle retaining wall section 40, second right angle retaining wall section 42, inwardly directed recess 44, L-shaped stabilizing wall 46, first stabilizing wall section 48 and second stabilizing wall section 50. However, in place of tongue 34, starter extrusion 72 includes an extension 76 which is coplanar with elongated planar section 74 and having a narrow channel 77 on one surface thereof and a large open channel 81 on an opposite surface thereof.

Figure 5:
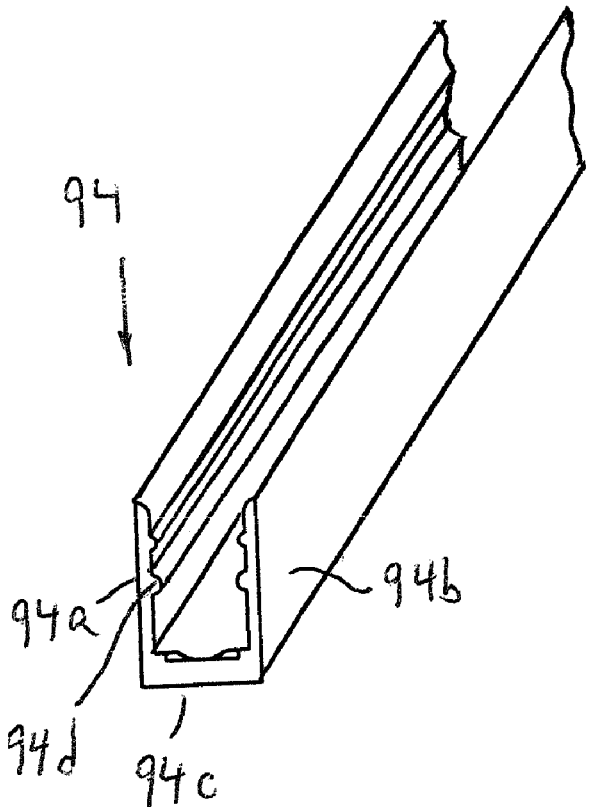
FIG. 5 is a perspective view of a U-shaped channel for securing the extrusions to the wall structure.

As shown in FIG. 7, which shows a side wall 14*a* and a floor 14*b* of wall structure 14, starter extrusion 72 is assembled with elongated planar section 74 flush against side wall 14*a* and with the free facing edge of extension 76 flush against floor 14*b*. One or two screws can be screwed through extension 76 in channel 77 and then into side wall 14*a* to hold starter extension 72 in position. Then, a wall panel 12*a* is assembled with starter extension 72 such that second right angle hook panel section 24 is inserted into inwardly directed recess 86, first right angle hook panel section 22 is flush against first stabilizing wall section 90 and the rear surface of planar main panel section 16 of wall panel 12*a* is flush against second stabilizing wall section 92. A U-shaped channel 94 (FIG. 5) formed by two parallel side walls 94*a* and 94*b*, and a connecting wall 94*c*, is then inserted in the space between floor 14*b* and first right angle hook panel section 22 such that connecting wall 94*c* is flush against extension 76. Screws can then be screwed through connecting wall 94*c*, extension 76 in channel 77 and then into side wall 14*a* to hold starter extension 72 in position. An elongated rubber plug 96 can then be inserted into channel 94 to provide an aesthetic appearance. In this regard, the inner surfaces of side walls 94*a* and 94*b* can be formed with beads 94*d*, and the outer surfaces of plug 96 can be formed with at least one elongated recess 96*a* for engagement by beads 94*d*.

It will be appreciated that the lowermost panel 12*a* of FIG. 8 has starter extrusion 72 in place of first extrusion 28*a* in the arrangement of FIG. 2. However, first extrusion 28*b* and second extrusions 30*a* and 30*b* are also assembled at different sides of wall panel 12*a*.

Then, as shown in FIG. 4, a next wall panel 12*b* is assembled such that first extrusion 28*a* assembled with wall panel 12*b* is connected with second extrusion 30*a* assembled with wall panel 12*a*, that is, with tongue 34 being inserted into groove 54. U-shaped channel 94 is then inserted in the space between facing outer surfaces of first right angle panel sections 22 of wall panels 12*a* and 12*b*, and is positioned flush against elongated planar section 52 of second fastening extrusion 30*a*. Fastening devices, such as screws 98 are then screwed through connecting walls 94*c*, and elongated planar sections 32 and 52, including tongues 34, into side wall 14*a*. Rubber plugs 96 are then inserted into channels 94.

The same operation occurs at the adjacent sides of each wall panel 16. This operation continues until the wall panels 12 reach the ceiling (not shown), and the same operation is performed, as was performed at floor 14*b*, by using starter extrusion 72.

Figure 9:
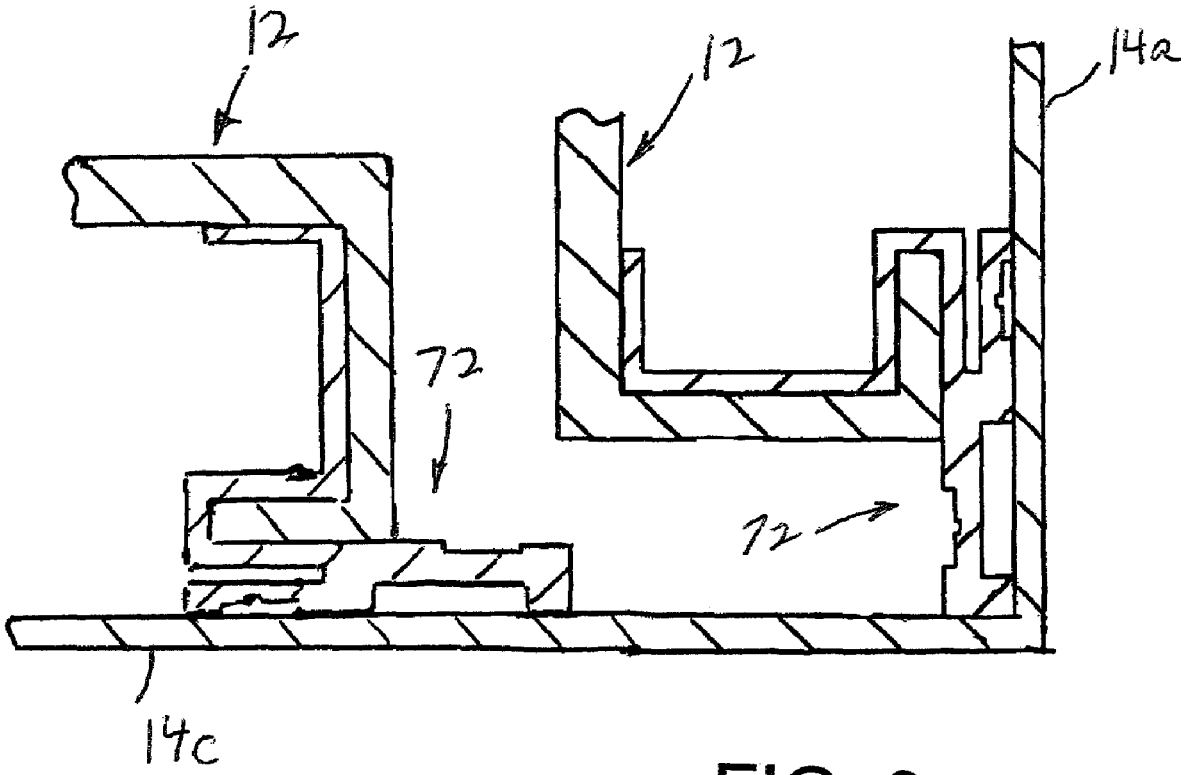
FIG. 9 is a horizontal cross-sectional view showing the starter extrusion mounted two adjacent wall panels at a corner of the wall structure.
Figure 10:
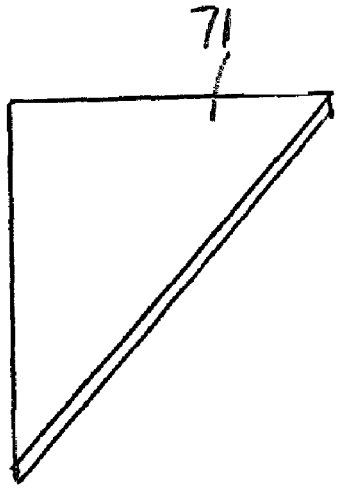
FIG. 10 is a perspective view of a corner securing member.

FIG. 9 shows the assembly at the corner of adjacent side walls 14*a* and 14*c*. Specifically, starter extrusions 72 are used for the edges of side panels 12 at the corners. U-shaped channels 94 (not shown in FIG. 9) are also preferably assembled with starter extrusions 72 in the same manner as previously discussed. In addition, a rubber plug 96 (not shown in FIG. 9) can be inserted between adjacent corner panels 12.

It will therefore be appreciated that a novel system 10 for easily mounting wall panels 12 over an existing wall structure 14 has been described which does not require the use of fastening devices to secure wall panels 12 to main fastening extrusions 26 or starter extrusions 72, and specifically, in which each wall panel 12 has a U-shaped hooked structure 20 at its ends which are securely held at extrusions 26 and 72 without any fastening devices, such as screws or the like. This arrangement prevents wall panels 12 from being pulled out away from existing wall structure 14. Further, wall system 10 is easy to assemble with an existing wall structure 14 and in which extrusions 14 by fastening devices, thereby increasing the structural integrity thereof. Also, extrusions 28, 30 and 72 are assembled flush against an existing wall, thereby adding to the structural integrity.

It will be appreciated that various modifications can be made to the present invention within the scope of the claims. For example, second stabilizing wall sections 50 and 70 can be eliminated. As another alternative, channels 94 can be eliminated, and rubber plugs 96 merely inserted in the gap between adjacent wall panels 12.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A system for mounting wall panels to an existing wall structure, comprising:

a plurality of wall panels, each wall panel having a main panel section and hook walls at edges of the main panel section, with the main panel section and each hook wall defining a U-shaped cross-sectional profile;

a plurality of fastening extrusion assemblies, each fastening extrusion assembly including:

a first retaining wall structure including a first recess for receiving one said hook wall of a first said wall panel, a second retaining wall structure including a second recess for receiving one said hook wall of a second said wall panel, a securing section for securing each fastening extrusion assembly to an existing wall structure, and a tongue and groove assembly for connecting together said first retaining wall structure, said second retaining wall structure and said securing section so as to maintain said first and second wall panels in a predetermined relation when said securing section is secured to the existing wall structure and said first retaining wall structure is assembled with said first wall panel and said second retaining wall structure is assembled with said second wall panel.

2. A system according to claim 1, wherein said tongue and groove assembly includes a tongue connected with said first retaining wall structure and a groove connected with said second retaining wall structure.

3. A system according to claim 1, wherein said main panel section has a rectangular configuration with four said hook walls, with the recess of each retaining wall structure of each fastening extrusion assembly receiving one said hook wall of a respective said wall panel.

4. A system according to claim 1, wherein each U-shaped cross-sectional profile defines a recess therein, and each fastening extrusion assembly includes at least one stabilizing wall extending from a free end of a respective said retaining wall structure, with the stabilizing wall being received in one recess of a respective said U-shaped cross-sectional profile.

5. A system according to claim 4, wherein each stabilizing wall has an L-shaped cross-sectional profile.

6. A system according to claim 1, wherein said securing section and each said retaining wall structure together define a U-shaped cross-sectional profile.

7. A system according to claim 1, wherein said securing section of each fastening extrusion assembly includes a corner recess at least at opposite ends thereof, and further comprising corner plates for engaging within the corner recesses to secure together ends of adjacent said fastening extrusion assemblies to a same wall panel.

8. A system according to claim 1, further comprising at least one channel secured to the securing section and positioned between adjacent wall panels corresponding thereto.

9. A system according to claim 8, further comprising an elongated plug inserted into each channel for closing off the channel.

10. A system according to claim 1, further including a starter extrusion, each starter extrusion including a third retaining wall structure including a third recess for receiving one said hook wall of a respective said wall panel, and an extension for securing the starter extrusion to the existing wall structure.

11. A system according to claim 10, wherein the starter extrusion is used at edges of a respective said wall panel corresponding to corners between:

a side wall and floor, two side walls, and a side wall and a ceiling.

* * * * *